United States Patent [19]

Fast

[11] Patent Number: 4,779,367

[45] Date of Patent: Oct. 25, 1988

[54] MERCHANDISE INFORMATION TAG

[76] Inventor: Jacob Fast, 7561 NW. 9th St., Plantation, Fla. 33317

[21] Appl. No.: 358,925

[22] Filed: Mar. 17, 1982

[51] Int. Cl.[4] ..... G09F 3/18

[52] U.S. Cl. ..... 40/657; 40/584; 40/124.1

[58] Field of Search ..... 40/2, 19.5, 10 R, 124.1, 40/20 R, 584

[56] References Cited

U.S. PATENT DOCUMENTS

| | | | |
|---|---|---|---|
| 1,054,927 | 3/1913 | Marsh et al. | 40/20 R |
| 1,776,553 | 9/1930 | Fulkerson | 40/19.5 |
| 1,792,075 | 2/1930 | Cooper | 40/20 R |
| 2,188,310 | 1/1940 | Price | 40/2 R |
| 2,721,408 | 10/1955 | Harris et al. | 40/2 |
| 2,859,546 | 11/1958 | Gutterson | 40/10 R |
| 3,707,049 | 12/1972 | Thalenfeld | 40/10 R |

FOREIGN PATENT DOCUMENTS

| | | | |
|---|---|---|---|
| 390587 | 4/1933 | United Kingdom | 40/19.5 |

*Primary Examiner*—Gene Mancene
*Assistant Examiner*—Wenceslao J. Contreras
*Attorney, Agent, or Firm*—Holman & Stern

[57] ABSTRACT

A product identification tag is made of transparent plastic and takes the form of a planar card from which one or more integrally-formed support portions project. In one embodiment, the support portion is slotted to receive J-hook or peg hook portions so as to be suspended from the hook, whereby an attached pressure-sensitive adhesively backed label is visible. In another embodiment, the support portions are flexible anchor arms which can be folded out of the card plane, each arm including a distal end with wing-like projections that can be flexed to permit insertion of the wings in the peg board holes and unflexed so as to anchor against the back surface of the peg board. The tags are die-cut from plastic sheets, preferably with adjacent tag edges sharing common die-cuts in order to conserve material.

15 Claims, 3 Drawing Sheets

MERCHANDISE INFORMATION TAG

TECHNICAL FIELD

The present invention relates to merchandise information tags which are associated with merchandise displays and generally bear price and/or product identification legends or codes. More specifically, the present invention relates to improvements in such tags.

BACKGROUND OF THE INVENTION

Point of sale merchandising displays very often involve the use of peg hooks, which project outwardly from apertured boards or other vertically-oriented apertured walls, or J-hooks, which secure to the price molding formed at the exposed edge of a merchandising shelf. Blister packs are generally suspended from these hooks in the manner in which they can be readily displayed in an attractive manner for passers by. Many such displays employ product information tags or cards which include price or information legends or codes and serve to indicate when a product is out of stock. Specifically, one prior art product information card is described and illustrated in U.S. Pat. No. 4,245,414 (Shypula), wherein the "out-of-stock" card is suspended from a peg hook behind the displayed merchandise so that its product description is visible after all of the merchandise has been removed from the hook. In this manner, the proprietor is made aware of the need to purchase replacement items. It should be noted, however, that since the card is not visible until the product is out of stock, the proprietor often is faced with not having the product in stock during the time between reorder and delivery.

Other types of product information tags are adhesively-backed paper tags which, upon the removal of a temporary backing, are affixed directly to a price molding or other support surface. Such tags, however, tend to curl, and tear and are not re-usable.

Generally, the cards and tags of the type described above tend to be eye-sores because of their bright colors. In addition, the aforementioned cards and tags, once affixed to the support hook or support surface, will limit the flexibility of the merchandise display because the tags cannot be readily moved so as to permit relocation of existing merchandise on the display or changes in the type of displayed merchandise.

SUMMARY OF THE INVENTION

It is therefore an object of the present invention to provide a product information tag which is supported in a manner so as to be visible prior to depletion of stock and yet is sufficiently unobtrusive so as not to present an eye-sore.

It is another object of the present invention to provide a product information tag which is re-usable for a variety of different products and which is mounted in such a way as to permit relocation of the displayed merchandise, along with the tag, without destroying the tag or in any way limiting the position of the merchandise.

It is another object of the present invention to provide a product information tag which is durable, maintains its substantially planar configuration and which can be oriented in a variety of different positions so as to permit increased merchandise display flexibility.

It is still another object of the present invention to provide a product information tag which can be massproduced simply and inexpensively and yet which has all of the advantages set forth in the preceding objects of the present invention.

In accordance with the present invention, an information tag for displayed merchandise takes the form of a transparent plastic planar card-like member or sheet which is sufficiently rigid so as to remain planar when supported vertically along its lower edge. At least one surface, namely the display surface, of the tag readily adheres to the adhesive backing of pressure-sensitive labels which can be placed one over the other as the tag is used with different products. The indicia-bearing portion of the tag is preferably rectangular and includes a tag-supporting structure extending outwardly from one of the edges of the rectangle and formed integrally therewith. In one embodiment, the tag-supporting structure includes a narrow neck portion which joins the rectangular indicia-bearing portion with a slotted distal portion. The slot in the distal portion extends parallel to the edge of the indicia-bearing portion from which the support stem or neck extends. The slot has a predetermined length which is equal to or only slightly greater than the support prongs of a peg hook or the support member of a J-hook so that the tag can be suspended from its slot through which the support structure of the peg hook or J-hook is inserted. Since the peg hooks and J-hooks can be moved to different locations along an apertured board or price molding, as the case may be, the tag is movable therewith so as not to preclude flexibility in the locations of the displayed merchandise. The tag can be displayed with its indicia-bearing portion projecting upward or downward from the slot, depending upon the nature of the displayed merchandise and whether or not the proprietor desires that the tag be visible prior to depletion of the stock. The tag has further flexibility in that the space between the slotted portion and the indicia-bearing portion, on either side of the stem or neck, may alternatively serve as a support structure for certain types of merchandise display hooks.

In another embodiment, the support structure includes a pair of anchor-like members projecting from opposite edges of the card and take the form of a stem with winglike members at its distal end. The anchor-like members are positioned to be inserted through holes in an apertured board or the like with the wing-like members serving as anchors against the rear surface of the board to prevent inadvertent removal of the tag from the apertured board.

In both embodiments, the tags are preferably die-cut in multiple numbers in a sheet with adjacent edges of adjacent tags sharing common die-cut lines to thereby minimize the waste of material in the sheet.

BRIEF DESCRIPTION OF THE DRAWINGS

The above and still further objects, features, and advantages of the present invention will become apparent upon consideration of the following detailed description of one specific embodiment thereof, especially when taken in conjunction with the accompanying drawings, wherein.

DESCRIPTION OF THE PREFERRED EMBODIMENTS

Figure 1:
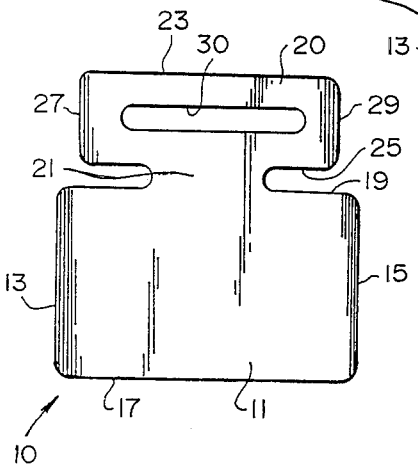
FIG. 1 is a view in plan of a product information tag according to one embodiment of the present invention.

Referring specifically to FIG. 1 of the accompanying drawings, a tag according to a first embodiment of the present invention is generally designated by the reference numeral 10. Tag 10 is made of transparent plastic material and, in the preferred embodiment, is preferably made of polypropylene with a thickness on the order of 15 mils. Tag 10 includes a generally rectangular indicia-bearing portion 11 having opposed short sides 13, 15 and opposed long sides 17, 19. The front and back surfaces of indicia-bearing portion 11 of the tag both readily adhere to the adhesive provided on the reverse side of pressure-sensitive labels of the type which are generally provided with removable backing paper to protect the adhesive coating prior to deployment of the label. Such labels are used in conjunction with tag 10 to provide the indicia which appears on indicia-bearing portion 11. A tag-support structure 20 is disposed at the distal end of a short neck or stem portion 21 which extends outwardly from edge 19 of the indicia-bearing portion 11. The support structure is generally rectangular and includes relatively long sides 23, 25, which are parallel to edge 19, and relatively short sides 27, 29, which are perpendicular to edge 19. Edges 23 and 25 are shorter than the parallel edges 17 and 19 of indicia-bearing portion 11; likewise, short edges 27, 29 are shorter than the corresponding edges 13, 15 of indiciabearing portion 11. An elongated slot 30 is defined in support structure 20 with its length dimension extending parallel to edges 23 and 25. The length of slot 30 is greater than the corresponding dimension of stem 21 and is totally enclosed within support structure 20.

Figure 2:
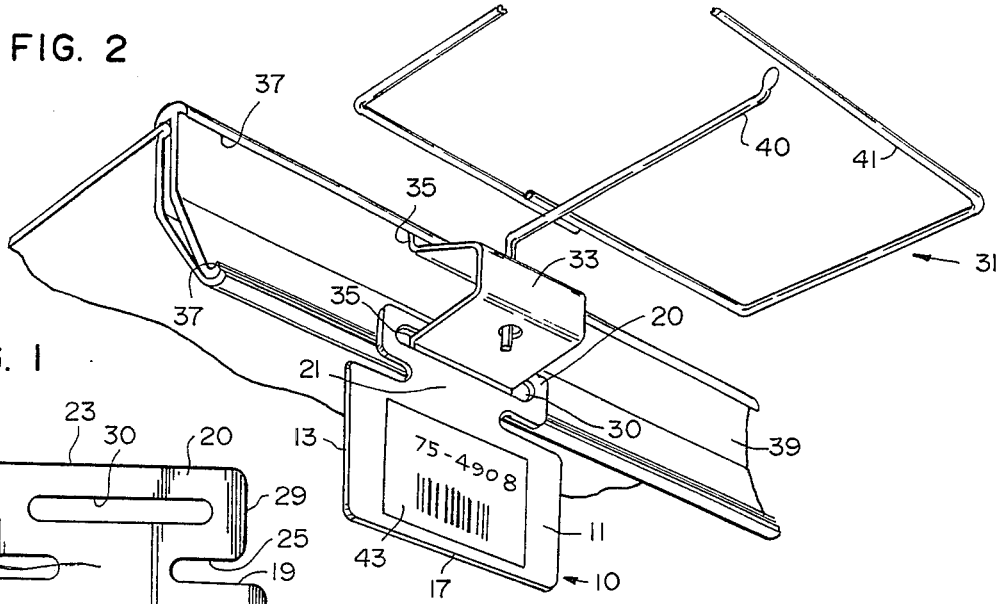
FIG. 2 is a view in perspective of the tag of FIG. 1 suspended from a J-hook which is attached to a price molding for a merchandise display.

Referring to FIG. 2, tag 10 is shown to be suspended from the support portion of a J-hook which is generally designated by the reference numeral 31. J-hook 31 includes a generally U-shaped bracket member 33 having outwardly projecting lips 35 formed at the distal ends of its legs. Bracket member 33 is resilient such that its legs may be squeezed toward one another to permit lips 35 to be engaged within respective horizontally-extending support channels 37 of a price molding 39. The price molding 39 is a commonly employed molding member secured to the forward edge of a product display shelf and to which product-identification cards, as well as support brackets for hooks, are secured. The J-hook 31 includes a support bar 40 which is secured to bracket 33 and projects forwardly of price molding 39. Support bar 40 is arranged to be inserted through apertures in blister pack display items which are thereby suspended from the support bar 40 in front of price molding 39. The J-hook 31 is also shown to include a protective frame 41 of generally rectangular configuration and provided so as to protect passers-by from injury by impacting against the distal end of bar 40.

Figure 3:
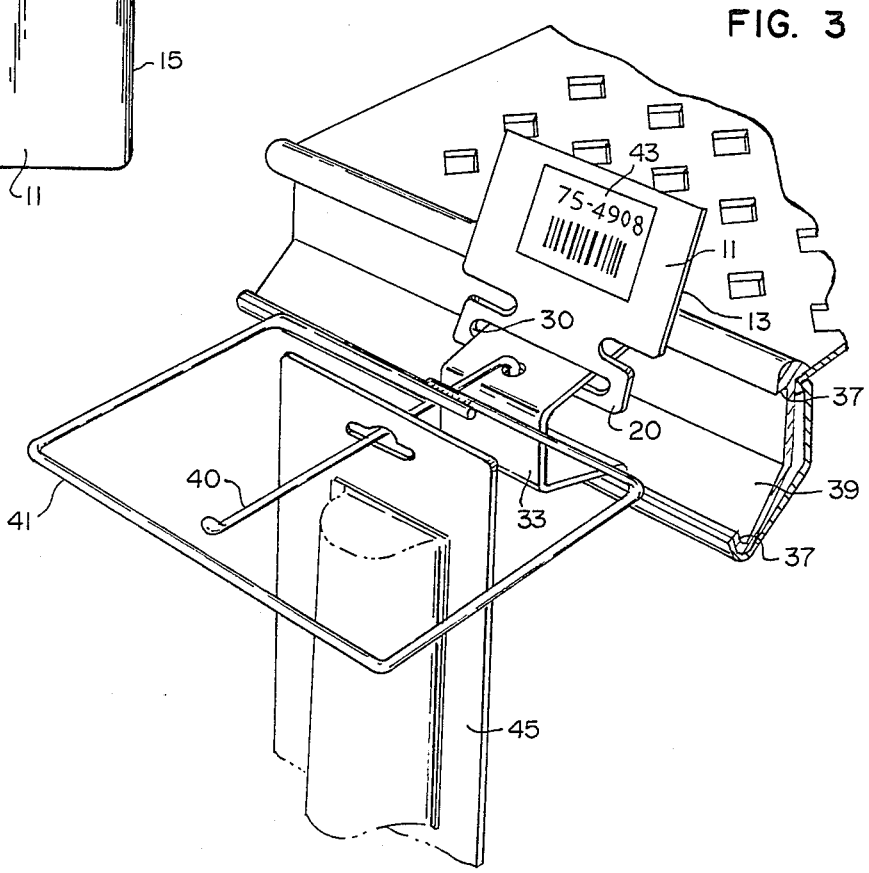
FIG. 3 is a view in perspective of the tag of FIG. 1 secured to a J-hook similar to that illustrated in FIG. 2 but wherein the tag is supported in a position inverted relative to that of FIG. 2.

Tag 10, in the deployment mode illustrated in FIG. 2, has the lower leg of bracket 33 extending through slot 30 with the indicia-bearing portion 11 suspended below the tag support structure 20. In addition, a gummed or adhesively backed product identification label 43 is secured to the outwardly facing side of indicia-bearing portion 11 of tag 10. When supported in this manner, the tag 10 resides behind the displayed merchandise which is suspended from bar or rod 40. Alternatively, as illustrated in FIG. 3, tag 10 may be supported with the upper leg of bracket 33 extending through slot 30 so that the indicia-bearing portion 11 of the tag resides above the tag support structure 20. With this mode of deployment, the indicia appearing on label 43 are visible above the blister packs 45 suspended from rod 40. It will be readily appreciated, of course, that if support bracket 33 is replaced by a support member extending in a substantially vertical plane, the tag 10 can likewise be supported with slot 30 extending vertically rather than horizontally as illustrated in FIGS. 2 and 3. Under such circumstances, the tag 10 will extend to the side of the displayed products and will also be readily visible, if desired. It is important that the slot 30 have a length which is at least equal to the corresponding dimension of the leg of bracket 33 extending through the slot. It is also important, particularly when the tag 10 is supported in the manner shown in FIG. 3, that the tag have sufficient rigidity so as not to bend or curl when the indicia-bearing portion 11 is disposed above the support structure 20. The 15 mil thick polypropylene, noted above as useful in the preferred embodiment, has sufficient rigidity for this purpose. Of course, other types and thicknesses of plastic material have the same property.

The transparent nature of tag 10 prevents it from being an eye-sore and permits it to blend in with substantially any background. This is a feature which is important in attractive merchandise displays. An alternative method would be to use a plastic material of a suitable color to match or contrast with the background.

Figure 4:
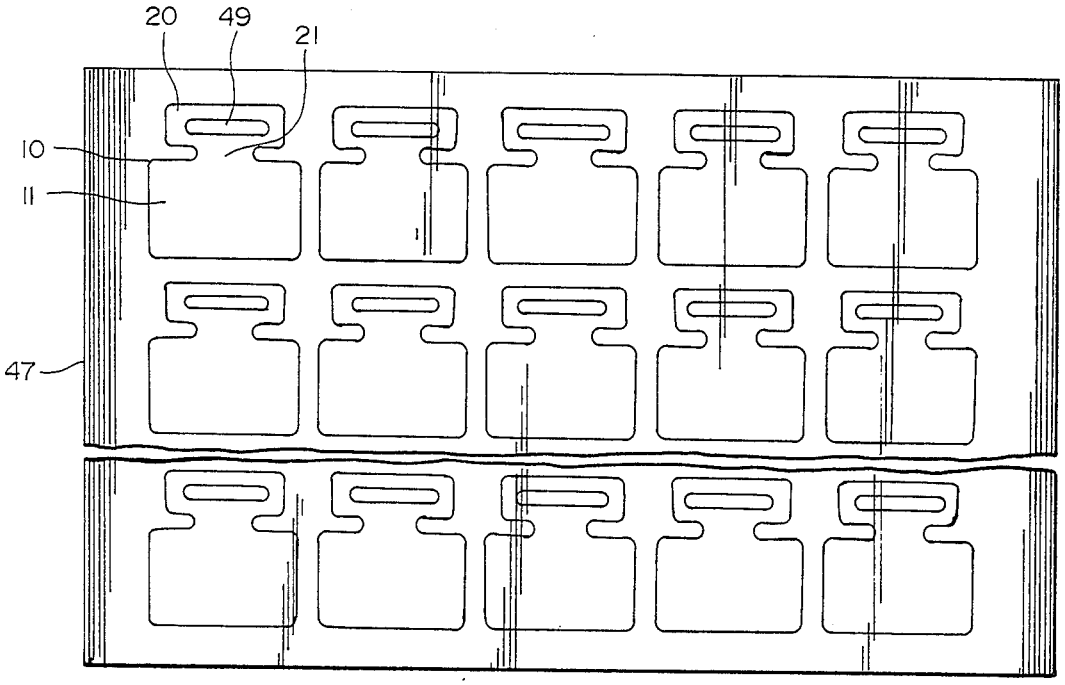
FIG. 4 is a view in plan of a sheet of plastic in which a plurality of tags of the type illustrated in FIG. 1 are die-cut.
Figure 5:
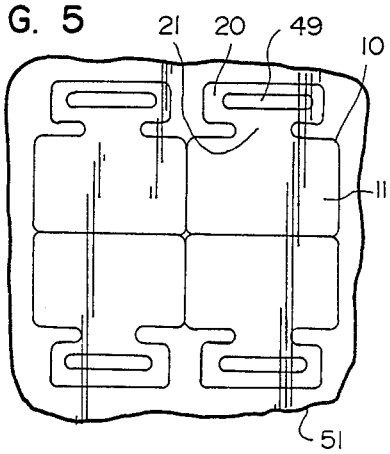
FIG. 5 is a cut-out portion of an alternative sheet of the type illustrated in FIG. 4 wherein space is conserved by die-cutting the tags in clusters.

Referring to FIG. 4, a sheet 47 of plastic material is shown die-cut to form a plurality of tags 10 of the type illustrated in FIG. 1. The die-cutting procedure is a well-known technique and need not be described herein. When a user wishes to remove a tag 10 from sheet 47, he or she need merely push that tag through the sheet so that it disconnects therefrom and then push the strip of material 49, which is disposed in slot 30, from the slot so as to open the slot and render the tag ready for use. The orientation of tags 10 on sheet 47 illustrated in FIG. 4, can be wasteful of plastic material. In order to conserve such material, the die-cuts can be made such that they are shared by adjacent edges of adjacent tags. For example, in referring to FIG. 5, sheet 51 is shown with tags formed in clusters of four (4) wherein each tag shares a die-cut along its bottom edge 17 and a side edge 13 or 15.

Figure 6:
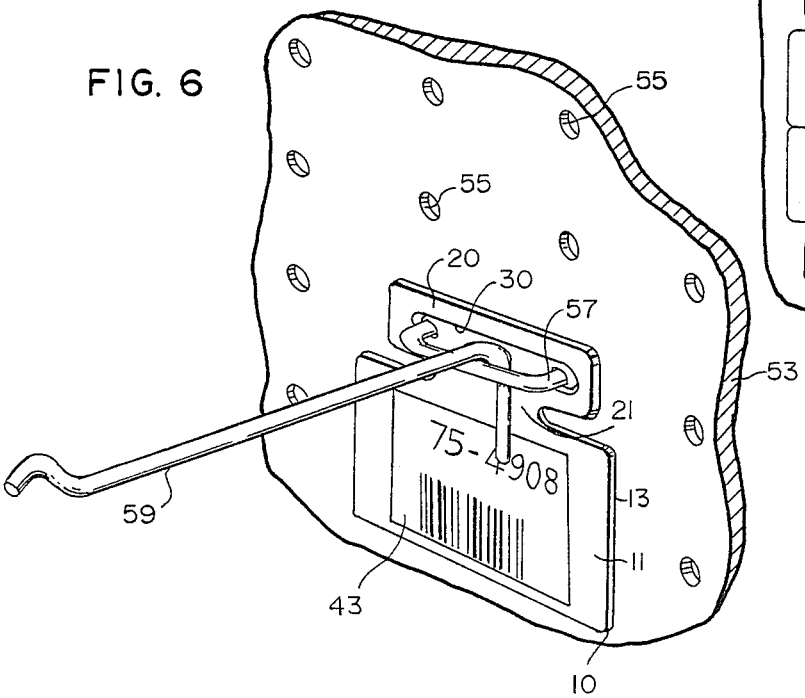
FIG. 6 is a view in perspective of the tag of FIG. 1 employed in conjunction with a peg hook and apertured board.

Tag 10 of FIG. 1 is also useful in conjunction with peg hooks in the manner illustrated in FIG. 6. Specifically, a peg board 53 is provided with a plurality of equally spaced holes 55 in the manner well-known in the merchandising display field. A conventional peg hook includes a support member 57 and a hook member 59. Support member 57 is a bar bent into a generally U-shaped configuration with its legs spaced to permit each to be inserted through a respective hole 55 in apetured board 53. The extreme ends of the legs (not shown) of member 57 are bent downwardly so as to engage the back wall of apertured board 53 when member 57 is inserted therein. Hook member 59 has a rear portion which is disposed in the space between support member 57 and apertured board 53 so that the merchandise has a supporting hook which projects forwardly of the apertured board. Tag 10 is placed against apertured board 53 with the base of support member 57 projecting outwardly through slot 30. The tag is held against the peg board by hook member 59 so that the tag does not slip off the support member 57. The tag 10 is illustrated in FIG. 6 in a manner analogous to that of FIG. 2 wherein the indicia-bearing portion 11 is suspended below the tag support portion 20; however, it should be apparent that the tag can be inverted so that the indicia-bearing portion 11 resides above the tag support portion 20.

Figure 7:
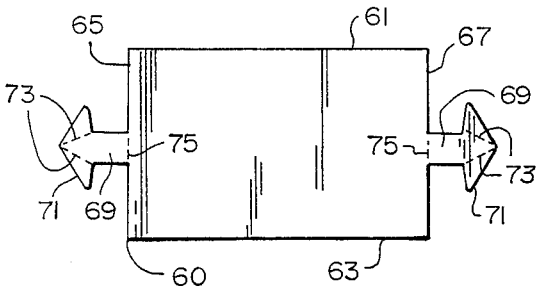
FIG. 7 is a view in plan of a tag in accordance with a second embodiment of the present invention.

A second tag embodiment in accordance with the present invention is illustrated in FIG. 7 and generally designated by the reference numeral 60. Tag 60 is made of transparent plastic material and is preferably in the form of a rectangle having two (2) long sides 61, 63 and two (2) short sides 65, 67. A first support structure includes a stem 69 extending as an integral part of the tag from short side 65. The distal end of stem 69 terminates in a bi-winged or anchor-like member 71. The wings of member 71 extend beyond the width of stem 69. Perforations 73 are provided to permit the wings to be folded resiliently inward. In addition, a perforation 75 is provided at the proximal end of stem 69 so that the stem may be folded, resiliently, out of the plane of the indicia-bearing portion of the tag 60.

An identical support structure, bearing like reference numerals, is provided to extend from the other short side 67 of tag 60. The two (2) stems 69 thus extend in opposite directions, terminate in anchor-like members 71 and are resiliently bendable out of the plane of the main body of tag 60.

Figure 8:
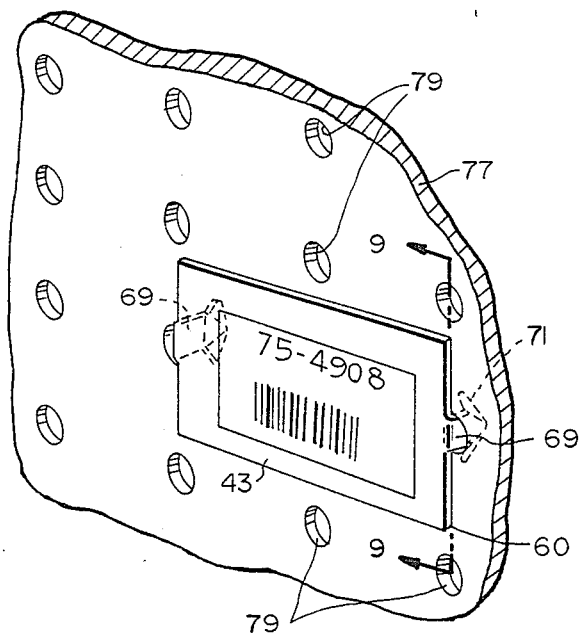
FIG. 8 is a view in perspective of the tag of FIG. 7 secured to an apertured board.
Figure 9:
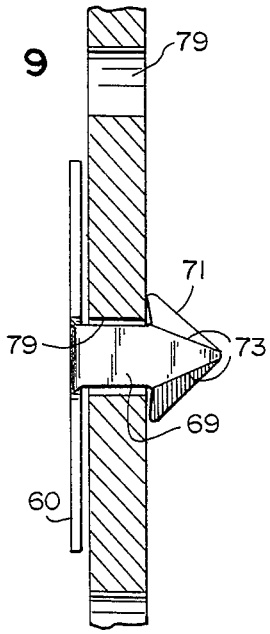
FIG. 9 is a view in section taken along lines 9—9 of FIG. 8.

Tag 60 is arranged to be secured to an apertured board 77 in the manner illustrated in FIG. 8. Specifically, apertured board 77 has a plurality of spaced holes 79 defined therethrough. Stems 69 have a width which is equal to or less than the diameter of holes 79 so that the stems can reside comfortably within the holes. Each stem may be inserted into a corresponding hole 79 by bending the anchor-like member 71 along fold lines 73 so that the anchor-like member may be forced through the hole. After being thusly inserted into the hole, the anchor-like member expands so as to prevent inadvertent withdrawal of the anchor-like member by virtue of the latter contacting the rear surface of the apertured board 77.

The dimensions of the sides 61, 63, 65, 67 of the tag 60, and the length of stems 69 are chosen to permit insertion of the stems into apertured board holes 79 having a prescribed spacing therebetween. The spaced holes need not be the most closely spaced holes on the peg board but instead, as illustrated in FIG. 8, can be any two (2) spaced holes. Thus, in the embodiment illustrated in FIG. 8, if the spacing between holes is considered uniform and equal to the value X, the opposed stems of tag 60 are designed to be inserted into holes having a spacing 2X. It should be noted that the stems need not be bent along the edges from which they project from the tag in the manner shown in FIG. 8; rather, the long sides 61, 63 of the tag may be shorter than the spacing between the insertion holes so that the stems extend along the front surface of the apertured board before being bent into the holes.

The tags can be removed and installed in other holes by simply reaching behind the peg board, folding the anchors along the fold lines and withdrawing the stems 69 from the holes in which they are inserted. Likewise, display tag 43 may be covered with other display tags depending upon the changes in the displayed product.

Figure 10:
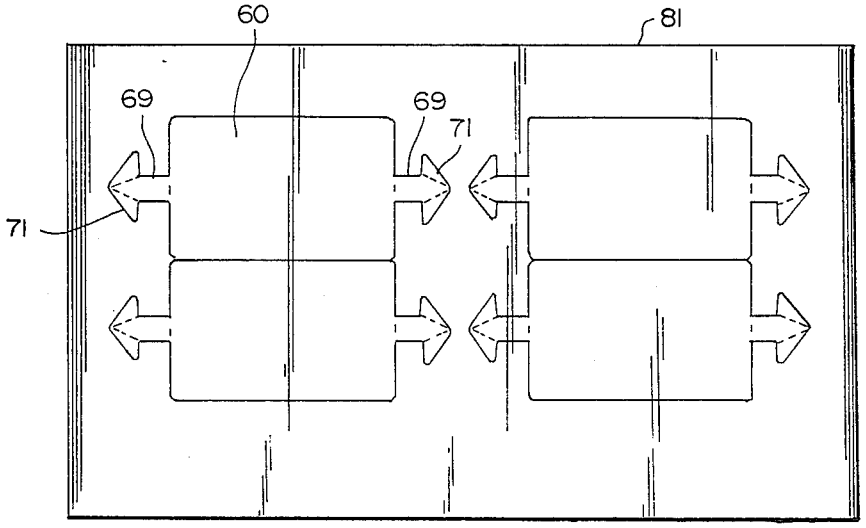
FIG. 10 is a view in plan of a sheet of plastic material in which a plurality of tags according to FIG. 7 are die-cut.

The tags 60 may be formed as die-cuts in a sheet 81 in the manner illustrated in FIG. 10. The die-cuts may be made so that adjacent tags 60 share a die-cut along their adjacent long edges. The tags 60 may be punched out or forced from sheet 81 when ready for use.

While I have described and illustrated various specific embodiments of my invention, it will be clear that variations of the details of construciton which are specifically illustrated and described may be resorted to without departing from the true spirit and scope of the invention as defined in the appended claims.

What is claimed is:

1. An article of manufacture in the form of a merchandise display tag for displaying merchandise-related information while being suspended from a support structure, said tag comprising a substantially planar plastic card-like member having an information display portion longitudinally spaced from a support portion by a stem which is transversely narrower than each of said support portion and information display portion, said information display portion being integrally formed with said support portion and said stem, said tag further including a transversely-extending slot for engaging said support structure defined in said support portion with a transverse dimension along said tag that is greater than the smallest transverse dimension of said stem, wherein said support portion and said information display portion are spaced longitudinally from one another by the length of said stem at transversely opposite sides of said stem, thereby defining two transversely-spaced support spaces on said opposite sides of said stem for engaging said support structure alternatively to said slot.

2. The article of manufacture according to claim 1, wherein said plastic is polypropylene having a thickness of approximately 15 mils.

3. The article of manufacture according to claim 1, further comprising a sheet of molded plastic material in which a plurality of said tags are peripherally die-cut for snap-out removal from the sheet and wherein said slot is die-cut to permit snap-out removal of said plastic material from said second portion of each tag.

4. The article of manufacture according to claim 3, wherein each tag die-cut in said sheet shares a die-cut edge with an adjacent tag.

5. The article of manufacture according to claim 4, wherein said tags are die-cut in said sheet in clusters of at least four tags, each tag in a cluster sharing two die-cut edges with two other adjacent tags in that cluster.

6. The article of manufacture according to claim 1, wherein said support member includes an elongated edge of a J-hook price molding support, said elongated edge defining said at least one lineal path.

7. The article of manufacture according to claim 1, wherein said support member includes a generally U-shaped bracket forming part of an apertured board structure, the bracket having parallel leg portions which are adapted to extend through spaced holes in an apertured board which define said at least one lineal path between them.

8. The article of manufacture according to claim 1, wherein said support structure includes two spaced elements which engage said support structure in said two support spaces, respectively, and are spaced by a distance greater than the width of said stem.

9. The article of manufacture according to claim 1 wherein said support portion is generally rectangular with longitudinally-extending edges and transversely-extending edges, and wherein said slot has its longest dimension extending parallel to said transversely-extending edges.

10. The article of manufacture according to claim 9 wherein said information display portion includes a transversely-extending edge disposed parallel to and across the support spaces from one of said transversely-extending edges of said support portion, and wherein each of said support spaces is defined longitudinally between said transversely-extending edge of said information display portion and said one of said transversely-extending edges of said support portion, said support spaces each being terminated at one end by said stem and being open at their ends opposite said stem.

11. The article of manufacture according to claim 10 wherein said information display portion is generally rectangular.

12. The article of manufacture according to claim 11 wherein the information display portion has a transverse width greater than the transverse width of said support portion.

13. The article of manufacture according to claim 1 wherein the dimensions of said slot and said support spaces along the longitudinal dimension of said tag are substantially equal.

14. Apparatus for displaying and identifying merchandise comprising:

merchandise support means for supporting said merchandise for display; and a product-identification tag in the form of a generally rectangular and substantially planar plastic card-like member having an information display surface adapted to adhere to a pressure-sensitive adhesively backed label, said card-like member having one edge from which tag support means projects as an integrally-formed part of said card-like member, said tag support means including first and second means for alternatively engaging said merchandise support member with said information display surface facing outward from said merchanidse support member so as to be visible to passers by, said tag support means having a relatively narrow proximal portion and a relatively wide distal portion.

15. The apparatus according to claim 14, wherein said distal portion is rectangular and has an elongated slot, corresponding to said first means for engaging, defined therethrough and extending substantially parallel to said one edge.

* * * * *